US005152490A

United States Patent [19]

Deutsch

[11] Patent Number: 5,152,490

[45] Date of Patent: Oct. 6, 1992

[54] DISPLAY EASEL WITH SELF-ADJUSTING PAPER CLAMP

[75] Inventor: Dennis Deutsch, Hastings, Minn.

[73] Assignee: Pierce Companies, Inc., Calif.

[21] Appl. No.: 745,913

[22] Filed: Aug. 16, 1991

[51] Int. Cl.[5] ..... A47B 97/04

[52] U.S. Cl. ..... 248/452; 40/341; 248/316.3; 248/457

[58] Field of Search ..... 248/452, 454, 456, 457, 248/441.1, 447, 451, 453, 316.3, 316.2, 558, 126, 470, 688; 40/341

[56] References Cited

U.S. PATENT DOCUMENTS

| | | | |
|---|---|---|---|
| 651,129 | 6/1900 | Becker | 248/470 |
| 2,247,131 | 6/1941 | Muldoon | 248/688 |
| 2,388,567 | 11/1945 | Patterson, Jr. | 248/688 X |
| 2,570,439 | 10/1951 | Forca | 248/452 |
| 2,707,228 | 4/1955 | Philipson | 248/688 X |
| 3,325,134 | 6/1967 | Henry | 248/316.3 X |
| 3,399,429 | 9/1968 | Goodman | 248/316.3 X |
| 3,591,013 | 7/1971 | Von Herrmann | 248/316.3 X |
| 4,199,173 | 4/1980 | Greenlees | 248/451 X |
| 4,531,642 | 7/1985 | Racich | 248/451 X |

OTHER PUBLICATIONS

International Tutor Machines Limited, "Unimate" Portable Presentation Aid.

*Primary Examiner*—Ramon O. Ramirez
*Attorney, Agent, or Firm*—Price, Gess & Ubell

[57] ABSTRACT

A display easel for placement on a desk or table functions as an erasable writing board, an easel to hold display placards, and a loose paper clipboard. The loose papers are held to the display easel by a self-adjusting clamp mechanism which automatically adjusts itself to the thickness of the paper pad and grips the papers to be held. The clamp mechanism comprises a cylindrical rod that slides up and down in a slot within a housing that receives the pad of loose papers. The pad is held fast to the display board by the cylindrical rod. The cylindrical rod slides up and down the housing, as needed, to accommodate the thickness of the pad.

26 Claims, 3 Drawing Sheets

FIG. 1
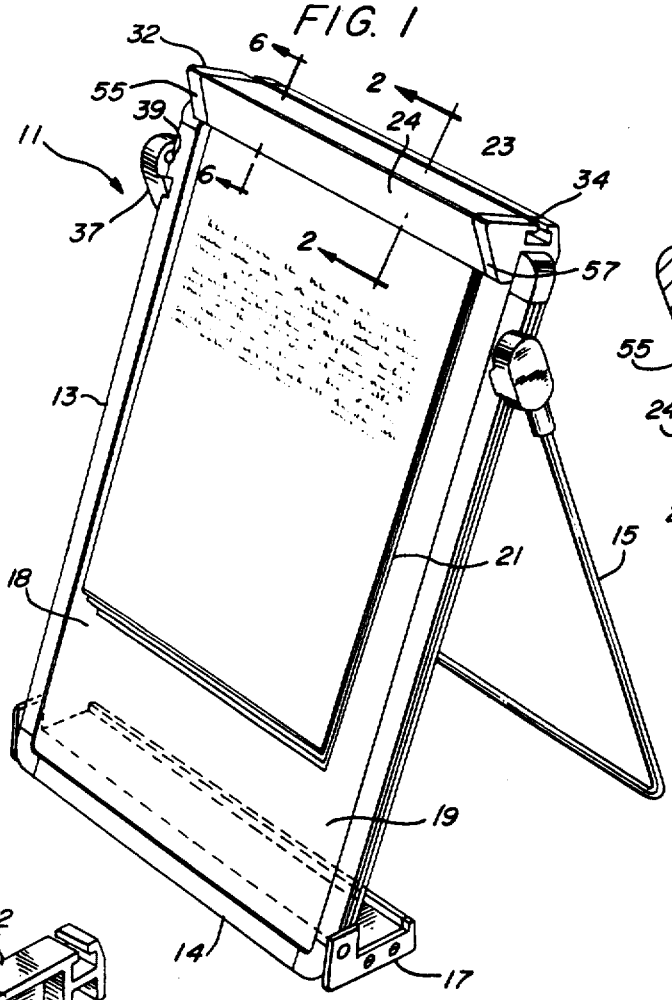
FIG. 2
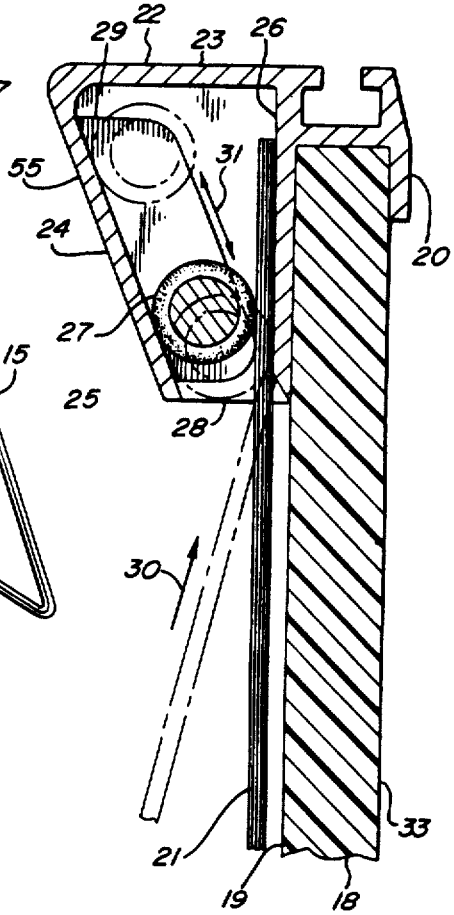
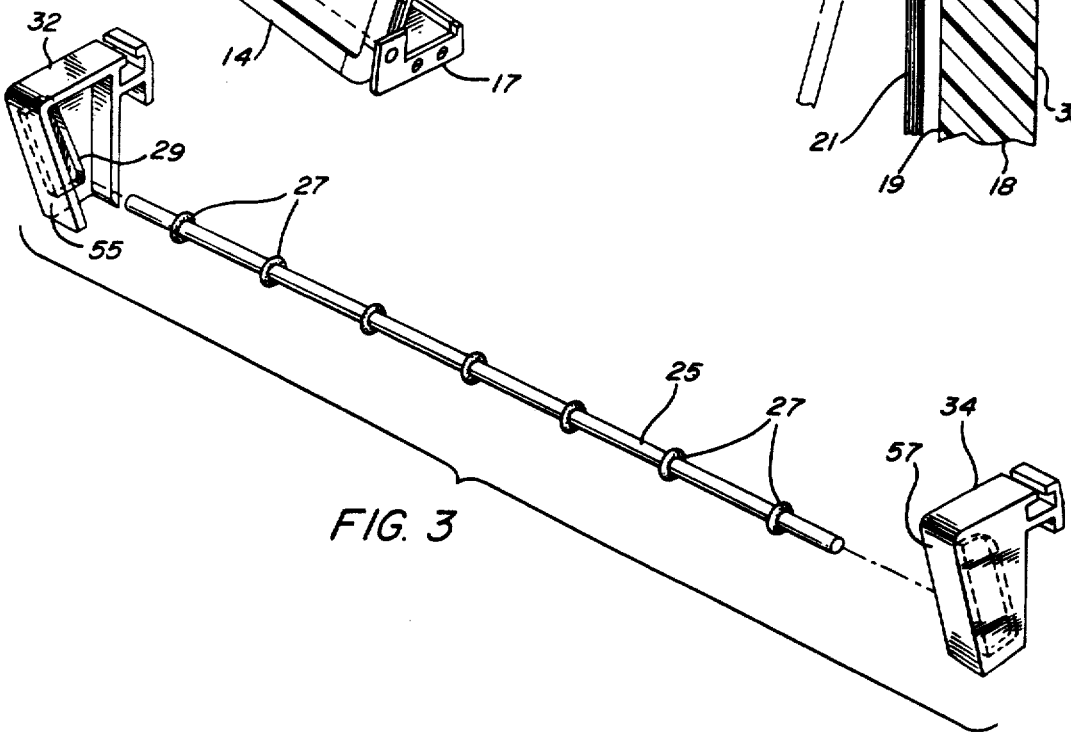
FIG. 3

DISPLAY EASEL WITH SELF-ADJUSTING PAPER CLAMP

BACKGROUND OF THE INVENTION

1. Field of the Invention

The present invention relates generally to improvements in display easels and, more particularly, pertains to new and improved paper clamping devices for easels wherein a pad of papers or a series of loose papers are held by the easel for display purposes.

2. Description of Related Art

In the field of display easels, it has been the practice to employ hand-manipulated clamps which are spring loaded or thumbtack or screw mechanisms to hold pads of papers or individual papers to the easel. Such devices have been unsatisfactory in that either individual pieces of paper could not be readily removed from the stack without tearing away the top sheet, or that if the top sheet was attempted to be removed, the remaining sheets below would also tend to fall away from the easel when the holding mechanism was released. Moreover, these prior art display easels did not facilitate their use as writing boards as well as placard display boards and paper holders.

SUMMARY OF THE INVENTION

The present invention overcomes the disadvantages of the prior art by providing a multifunction display easel which can hold placards, act as a writing board, automatically hold various thickness of loose papers, and is free-standing. The display easel is constructed so that both front and back may be used to write on. The front side has mounted at the top a self-adjusting loose paper clamp which automatically grips a variety of thicknesses of paper pads that are slipped into its receiving slot. The back side has mounted at the bottom a tray for holding placards. A swivel support leg adjusts to allow use of the front or back side. The self-adjusting loose paper clamp includes a cylindrical rod captured by its ends within a slot at either end of a housing mounted to the top of the display easel. The cylindrical rod moves in a plane that is at an angle to the plane of the display easel.

BRIEF DESCRIPTION OF THE DRAWINGS

The exact nature of this invention, as well as its objects and the advantages thereof, will become readily apparent from the following description when considered in conjunction with the accompanying drawings, in which like reference numerals designate like parts throughout the figures thereof, and wherein:

FIG. 1 is a perspective of the preferred embodiment of the present invention;

FIG. 2 is a cross-sectional view taken along line 2—2 of FIG. 1;

FIG. 3 is an assembly drawing of the paper holding mechanism utilized in the invention;

DESCRIPTION OF THE PREFERRED EMBODIMENTS

Figure 4:
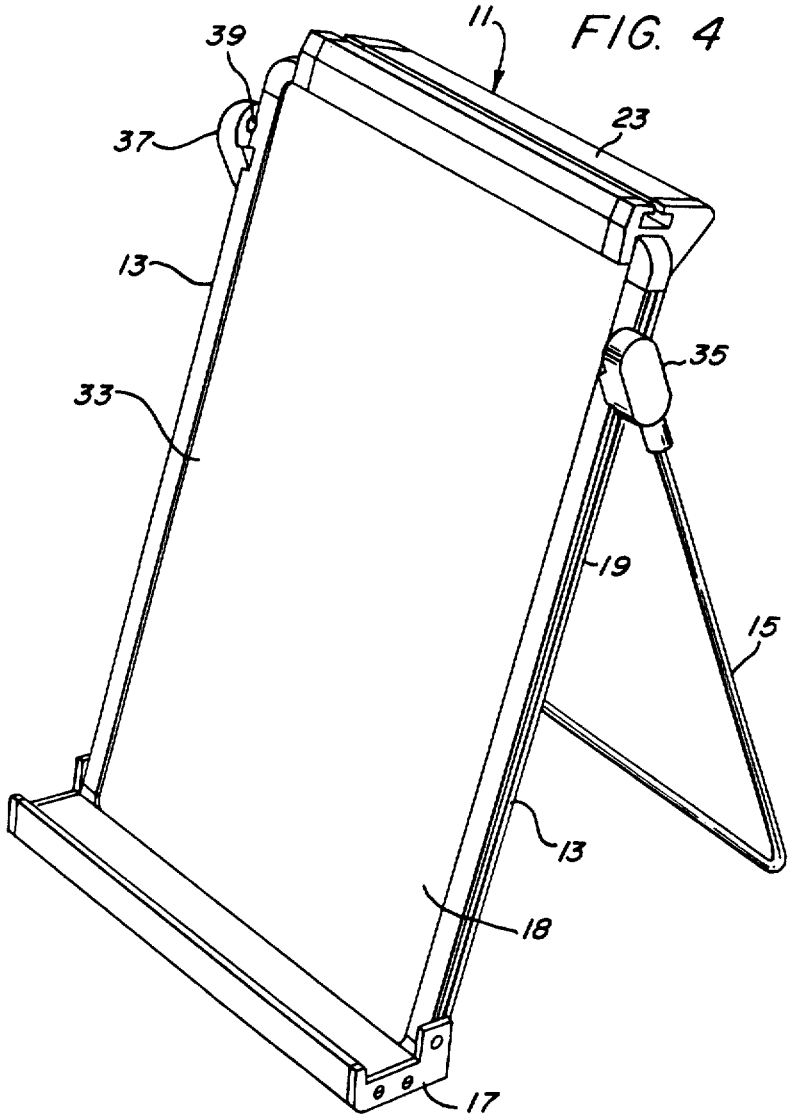
FIG. 4 is another perspective of the preferred embodiment of the invention shown in FIG. 1 placed in an alternate position.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a display easel with a self-adjusting, automatic paper holding clamp.

FIG. 1 shows a preferred embodiment of the display easel 11 as it would actually be used to hold a pad of papers 21. The easel 11 is made up of a planar surface with a front side 19 shown in FIG. 1 and its back side 33 shown in FIG. 4. The planar surface is mounted within a frame 13 which is preferably made out of a metal or plastic or similar material designed to withstand a certain amount of rough handling.

The planar surface 19 of the easel 11 rests on its bottom 14. An automatic paper clamping mechanism 23 is located at the top of planar surface 19. The structure of the automatic paper clamping mechanism 23 is preferably formed to be integral with the frame 13 of planar surface 19 of the easel 11.

An easel tray 17 is mounted at the bottom 14 of easel 11, as will be explained later. It may function to hold the bottom of placards in place while leaning up against easel 11. As illustrated in FIG. 1, it is shown acting as a support foot for easel 11.

Easel 11 is held in its display position by leg 15, which is preferably a U-shaped bracket with each arm of the bracket attaching to respective swivel mechanisms 35 and 37. Swivel mechanisms 35 and 37 are rotatably attached to frame 13 to permit the support leg 15 to swing from the back side 33 to the front side 19 of the planar surface of the easel 11.

FIG. 2 illustrates the cross-section taken along cross-sectional lines 2—2 of the automatic paper clamping mechanism shown in FIG. 1. Paper clamping mechanism 23 is shown to simply attach to planar surface 18 by means of a press-fit wherein the planar surface 18 simply slips into the hook cavity 20 formed at the back end of the paper clamp 23.

The automatic paper clamping mechanism 23 is essentially a housing with a single opening at its bottom 28. The housing of the clamping mechanism 23 has a back wall 26, a front wall 24 which is angled towards the back wall at an angle to a vertical plane which is parallel to the back wall 26, and a ceiling 22 which connects the front wall 24 with the back wall 26.

Mounted within this defined space or housing is the clamping mechanism itself, which is essentially a rod 25 that moves up and down, as indicated by arrow 31, within the space defined by the walls and ceiling of the automatic paper clamping mechanism 23. The rod 25 is captured in its movement by slots 29 located at each end of the automatic paper clamping mechanism 23.

Referring now to FIG. 3, the rod 25 and the end pieces 32, 34 of the automatic paper clamping mechanism 23 are more clearly illustrated. The rod 25 is preferably a cylindrical shaft that extends between the two end caps 32 and 34 of the automatic paper clamping mechanism 23. End cap 32 has a front face 55. End cap 34 has a front face 57. Each of these front faces are at the same angle as front wall 24. The shaft 25 has a plurality of soft surfaces 27 thereon which could be rubber or the like, and preferably are a plurality of 0-rings. The ends of shaft 25 are captured in respective slots 29 in end cap 32 and in end cap 34. The rod 25 is free to move up and down within the slot, as illustrated in FIG. 2.

As rod 25 moves up, the spacing between the rod and the back wall 26 of automatic paper clamping mechanism 23 increases. As the rod moves down, that spacing decreases. In this manner, the clamping mechanism is capable of accommodating a variety of thicknesses of paper pads and individual stacks of paper.

The clamping mechanism functions by the simple expedient of gravity. Gravity causes the rod 25 to slide to the bottom of the slot 29 to the point where the pad of paper 21 stops it from sliding down any further. The O-rings 27 mounted on the rod 25 press the pad of paper against the back wall 26 with sufficient force to hold the pad 21. When it is desired to remove the entire pad 21, or just a sheet out of the pad 21, removal is easily accomplished by simply pulling the paper out. A pulling force in a direction opposite to the insertion direction 30 will cause the shaft 25 to rotate within slots 29, permitting removal of paper 21. Conversely, insertion of pad 21 is accomplished simply by pushing the pad 21 in the direction 30 into the receiving slot 28 of the automatic paper clamping mechanism 23.

Referring now to FIG. 4, the display easel 11 of the present invention is illustrated to be in position for use as a writing board. The back side 33 of the planar surface may be an erasable writing surface for chalk, crayon, or other writing means. On the other hand, it may be a soft cork-type surface for use as a bulletin board. Besides acting as a support foot in FIG. 4, the easel tray 17 will also act as a support for any placards that would be placed against the back side 33 of the planar surface of the easel 11. The support leg 15 is shown to have rotated to the front side 19 of planar surface 18. When the display easel is in this position as a result of moving support leg 15 towards the front side 19 of easel 11, the automatic paper clamping mechanism 23 is not being utilized.

Figure 5:
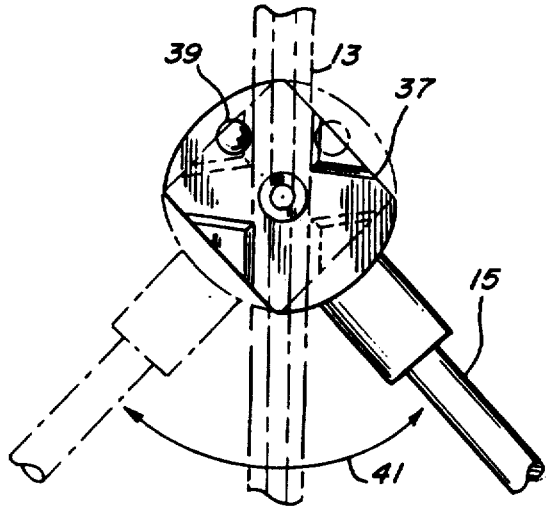
FIG. 5 is a partial side elevation of one of the leg attachments for the easel of the present invention.

FIG. 5 more clearly illustrates that the support leg 15 swivels between two support positions with respect to the frame 13 of easel 11. Support leg 11 is held in either one of these two positions by a detent button 39. Detent button 39 is captured in attachment block 37, which attaches to one extension of support leg 15. Another attachment block 35 swivels with respect to the other side of frame 13 and attaches to the other extension of support leg 15.

It may be desirable to have the display easel of the present invention sized so that it may fit into a display case. If papers are being held by the automatic holding mechanism, it becomes desirable to be able to lock the holding mechanism so that it does not disengage during transport of the easel. Such a locking mechanism is illustrated in FIGS. 6, 7, and 8.

Figure 6:
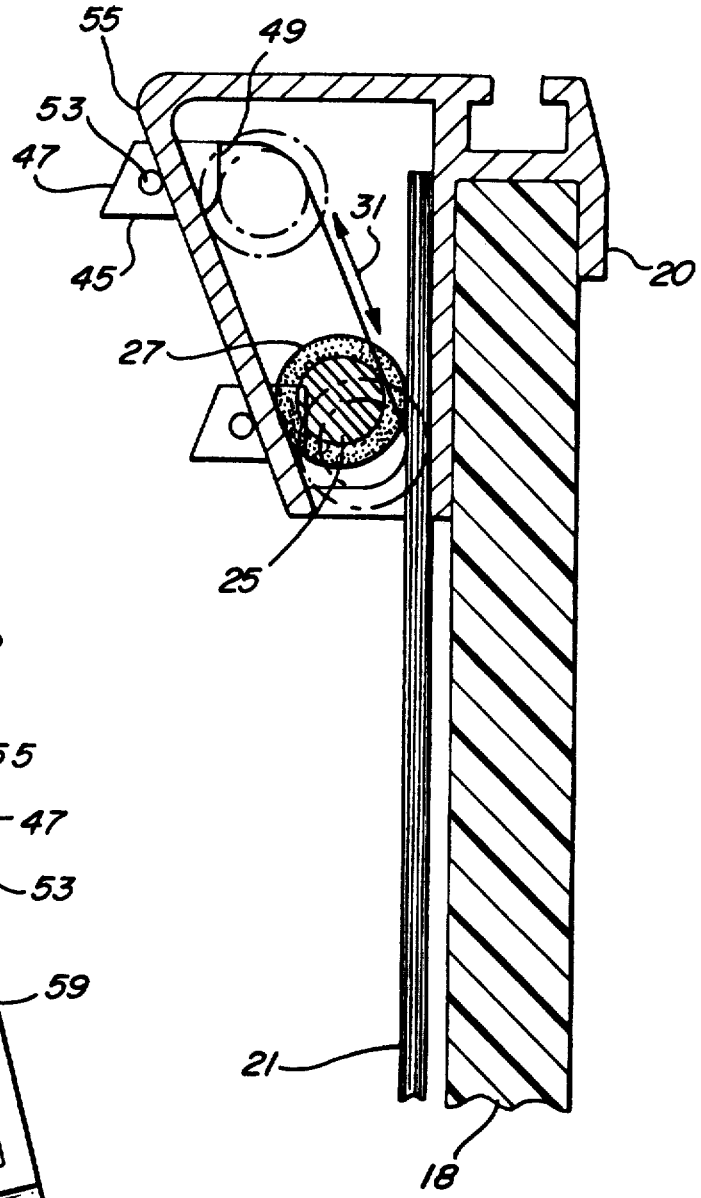
FIG. 6 is a cross-sectional view taken along line 6—6 of FIG. 1, showing an alternate end cap arrangement.

Referring first to FIG. 6, a cam slide 45 is shown as slidable in a plane parallel to the plane of movement for the rod 25 in the direction 31. The wedge-shaped locking portion 49 of the cam slide 45 wedges against the rod 25 when moved into position manually. The wedge-shaped locking portion 49 forces the rod 25 against any paper sheets 21 that may be located in the easel.

Figure 7:
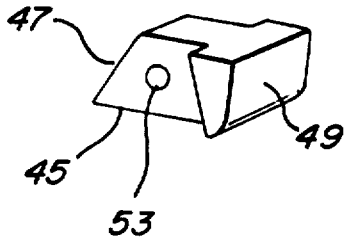
FIG. 7 is a perspective of a slide mechanism used in the embodiment of FIG. 6.
Figure 8:
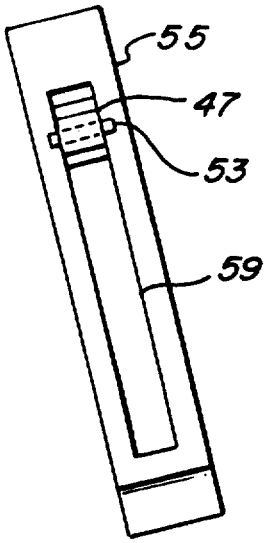
FIG. 8 is a front elevation of one of the end caps of the alternate embodiment of FIG. 6.

As can be seen in FIG. 7, the wedge-shaped portion 49 of cam slide 45 is wider than the manually actuatable portion 47 of the cam slide 45. The manually actuatable portion 47 fits through a slot 59 in the face 55 of one of the end caps 32 of the locking mechanism 23. The wider wedge-shaped portion 49 keeps the cam slide from coming through the slot. A friction peg 53 located in an aperture in the manually actuatable portion 47 of cam slide 45 keeps the cam slide from falling into the locking mechanism housing 23. The cam slide 45 can be slid along slot 59 by manually moving it at its end 47 until the wedge-shaped portion engages the rod 25 and locks it in place.

If very positive locking is desired, it may be advantageous to have a cam slide at each end of the rod 25 by placing one in each of the end caps 32, 34. The cam slide 45 is preferably made out of nylon in a single piece. The friction peg may be a metal or similarly strong material.

What has been described is a display easel having a planar surface that is supported in a manner in which both the front and back of the planar surface can be utilized for display purposes, and a self-adjusting automatic paper clamping mechanism being located on the planar surface for holding a variety of thicknesses of paper that may be inserted into the clamping mechanism.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A display easel, comprising:

a planar surface having a top, bottom, front, and back; and a paper clamping means mounted to the top of said planar surface, said clamping means self-adjusting to the thickness of the papers and holding the papers upon insertion into the clamping means;

a housing having an elongated front along said planar surface and end caps at each end;

a rod mounted for movement within said housing in a plane that is at an angle to the plane of said planar surface; and a cam slide mounted for movement in said housing.

2. The display easel of claim 1, wherein the cam slide is mounted for movement in one of said end caps of said housing.

3. The display easel of claim 1 wherein said rod is captured in slots, one in each of said end caps.

4. The display easel of claim 3 wherein said rod is cylindrical.

5. The display easel of claim 3 wherein said rod is disposed for sliding along said slots and rotating within said slots.

6. The display easel of claim 5 wherein said rod is cylindrical.

7. The display easel of claim 6 wherein said rod further comprises a plurality of rubber surfaces on said rod.

8. The display easel of claim 7 wherein said rubber surfaces comprise "O"-rings.

9. The display easel of claim 1 further comprising a tray attached to the bottom of said planar surface and extending along the entire length of the bottom.

10. The display easel of claim 9 further comprising a support leg attached to the sides of said planar surface to permit the display easel to stand freely.

11. The display easel of claim 1 further comprising a frame surrounding said planar surface.

12. The display easel of claim 11 further comprising a tray hinged to said frame at the bottom of said planar surface and extending along the entire length of the bottom.

13. The display easel of claim 12 further comprising a support leg rotatably attached to the sides of said frame to permit the display easel to stand freely.

14. The display easel of claim 13 wherein said support leg swivels to permit either the front or back of said planar surface to be the front face of the easel, and comprises locking means to lock said support leg into one of two positions.

15. The display easel of claim 14 wherein said locking means comprises a detent mechanism.

16. The display easel of claim 15 wherein said clamping means comprises:

a housing having an elongated front along said planar surface and end caps at each end; and a rod mounted for movement within said housing in a plane that is at an angle to the plane of said planar surface.

17. The display easel of claim 16 wherein said rod is captured in slots, one in each of said end caps.

18. The display easel of claim 17 wherein said rod is disposed for sliding along said slots and rotating within said slots.

19. The display easel of claim 18 wherein said rod further comprises a plurality of rubber surfaces along the length of said rod.

20. The display easel of claim 19 wherein said rod is cylindrical.

21. The display easel of claim 1, wherein the cam slide is mounted for movement in the elongated front of said housing.

22. The display easel of claim 2 wherein said cam slide includes a wedge-shaped portion for locking said rod into a fixed position.

23. The display easel of claim 2, further comprising another cam slide mounted for movement in another of said end caps of said housing.

24. The display easel of claim 23 wherein both of said cam slides and said another cam slide include a wedge-shaped portion for locking said rod into a fixed position.

25. A display easel, comprising:

a planar surface having a top, bottom, front, and back;

a paper clamping means mounted to the top of said planar surface, said clamping means self-adjusting to the thickness of the papers and holding the papers upon insertion into the clamping means;

a substantially enclosed housing having an elongated front along said planar surface and end caps at each end;

a cylindrical rod mounted for movement within said housing in a plane that is at an angle to the plane of said planar surface wherein said rod is captured in slots, one in each of said end caps, said slots being offset from an inner surface of said elongated front, wherein said rod is disposed for sliding along said slots and rotating within said slots; and a plurality of rubber surfaces encircling portions of said rod.

26. A display easel, comprising:

a planar surface having a top, bottom, front, and back;

a paper clamping means mounted to the top of said planar surface, said clamping means self-adjusting to the thickness of the papers and holding the papers upon insertion into the clamping means;

a tray hinged to said bottom of said planar surface to rest flat on a supporting surface, said tray extending along the entire length of the bottom; and a support leg rotatably attached to the sides of said planar surface to permit the display easel to stand freely;

wherein said support leg swivels to permit either the front or back of said planar surface to be the front face of the easel, and includes locking means to lock said support leg into one of two positions, said tray pivoting to remain flat against said support surface.

* * * * *